US005581873A

United States Patent [19]

Okura et al.

[11] Patent Number: 5,581,873

[45] Date of Patent: Dec. 10, 1996

[54] TEMPORARY HOLDING MEMBER FOR A WIRING ASSEMBLY MANUFACTURING APPARATUS

[75] Inventors: Yoshio Okura; Koji Fujita, both of Yokkaichi, Japan

[73] Assignee: Sumitomo Wiring Systems, Ltd., Mie, Japan

[21] Appl. No.: 394,962

[22] Filed: Feb. 27, 1995

[30] Foreign Application Priority Data

Mar. 3, 1994 [JP] Japan ..... 6-033479

[51] Int. Cl.[6] ..... H01R 43/00

[52] U.S. Cl. ..... 29/760; 29/755; 269/903

[58] Field of Search ..... 29/748, 752, 754, 29/755, 760, 33 M; 269/903

[56] References Cited

U.S. PATENT DOCUMENTS 3,601,890 8/1971 Pityo ..... 29/760 X
3,706,134 12/1972 Sweeney et al. ..... 29/755 X
5,355,581 10/1994 Soriano ..... 29/748 X

FOREIGN PATENT DOCUMENTS 44-20657 9/1969 Japan ..... 29/760
61-61489 12/1986 Japan .
5-242945 9/1993 Japan ..... 29/760

*Primary Examiner*—Peter Vo
*Attorney, Agent, or Firm*—Beveridge, DeGrandi, Weilacher, & Young L.L.P.

[57] ABSTRACT

Devices for treating a post-inserting terminal (31A) are disclosed. A lot of electric wires (31) laid out on a wire laying-out board (1) are fixed by a wire clamp (13), whereby the electric wires (31) project beyond the wire laying-out board (1), and also terminals (31A) caulked on ends of the electric wires (31). The electric wire of a post-inserting terminal (31A) among the terminals (31A) is detached from the wire clamp (13) by a terminal inserting device (570) and is temporarily held by a temporary holding member (147) on the wire laying-out board (1).

11 Claims, 12 Drawing Sheets

TEMPORARY HOLDING MEMBER FOR A WIRING ASSEMBLY MANUFACTURING APPARATUS

TECHNICAL FIELD OF THE INVENTION

The present invention relates generally to a method of treating a post-inserting terminal and a temporary holding member and a wire laying-out board used therefore, and more particularly, to a method of treating a post-inserting terminal and a temporary holding member and a wire laying-out board used therefore which are most suitable for a wiring assembly manufacturing apparatus of such a type as to manufacture a wiring assembly having a so-called post-inserting terminal using a wire laying-out board.

RELATED BACKGROUND ART

As means for automatically manufacturing a wiring assembly such as a wiring harness or a subassembly of the wiring harness, a conveying device equipped with devices for working electric wires into a wiring assembly and a wire laying-out board conveyed by the conveying device are well known (see, for example, Japanese Examined Patent Publication No. 61-61489).

In such an automatic manufacturing apparatus, the electric wires are laid out on the wire laying-out board and the wire laying-out board is conveyed in a predetermined order of processes using the conveying device, thereby to successively work on the electric wires laid out.

Devices equipped with the conveying device for conveying the wire-laying out board include a measuring and cutting device for reeling out an electric wire from a wire web and cutting the electric wire to predetermined lengths, a wiring laying-out device for laying out a lot of electric wires obtained by the cutting on a wire laying-out board, a stripping device for stripping insulated end portions of the laid out electric wires, a terminal clamping device for clamping terminals to the end portions of the stripped electric wires, and a terminal inserting device for inserting the clamped terminals into connector housings.

On the other hand, the wire laying-out board comprises a plate-shaped main body portion conveyed by the conveying device, a lot of wire laying-out jigs disposed on the upper surface of the main body portion, and a lot of wire clamps juxtaposed in a direction of the conveyance of the main body portion. The wire laying-out jig is constituted by pins and the like standing in the main body portion, so that it is easy to attach and detach the electric wires. On the other hand, the wire clamp is constituted by a clamping member urged by an urging member, and is opened and closed by jigs or devices such as a wire clamp head of the terminal inserting device. Electric wires to be worked into a wiring assembly are measured and cut to predetermined lengths, and the electric wires obtained by the cutting are then laid out above the main body portion by the wire laying-out jigs. On the other hand, the ends of the electric wires are detachably held in the wire clamps, whereby the ends of the electric wires project outwardly beyond the main body portion.

In the above described construction, the wire laying-out board is intermittently conveyed by the conveying device, whereby the wire laying-out board is successively conveyed to the respective devices equipped with the conveying device. When the wire laying-out board is stopped, the electric wires are processed by the respective devices, that is, the measuring and cutting process, the wire laying-out process, the stripping process, the terminal clamping process and the terminal inserting process are successively carried out. Since the ends of the electric wires project outwardly with respect to the main body portion of the wire laying-out board in order to face the respective devices, stripping, terminal clamping, and terminal inserting processes can be easy to carry out.

The terminals caulked on the ends of the electric wires are connected to each other through the connector housings, and also are used in the post-inserting process for connecting to another wiring assembly, or another electric wiring system, or the like. In the terminal inserting process, therefore, all the terminals caulked on the ends of the electric wires are not always inserted into the connector housings. In many cases, only the particular terminals may be inserted into the connector housings and contained inwardly with respect to the wire laying-out board. Consequently, the rest of the terminals (hereinafter referred to as "post-inserting terminal") still project beyond the wire laying-out board until the final process of one wiring assembly manufacturing apparatus is finished, so that the end of the electric wire with respect to the post-inserting terminal remains on the wire clamp on the wire laying-out board.

As a result, when the electric wires constituting the wiring assembly after passing through the respective processes are detached from the wire laying-out board, a worker must force the wire clamps by hand to detach an electric wire portion of the post-inserting terminal from the wire clamp. Such a manual operation increases the number of processes and therefore requires considerable expenditure of time and physical effort by the worker. Moreover, when the wire clamp is forced to open by a jig, the electric wires may be damaged by an edge portion of the jig or the wire clamps.

Furthermore, it is considered that the electric wire with respect to the post-inserting terminal is detached from the wire clamp by utilizing the terminal inserting device to bring the electric wire into a free state prior to the detaching process of the completed wiring assembly. In this case, however, the post-inserting terminal may also be deformed, for example, when the wire laying-board after passing through the terminal inserting process is conveyed toward the downstream side.

Therefore, what is really needed are a method of treating a post-inserting terminal on a wire laying-out board and a temporary holding member and a wire laying-out board used therefore which are efficient and at low cost.

DISCLOSURE OF THE INVENTION

The present invention relates to a method of treating a post-inserting terminal and a temporary holding member and a wire laying-out board used therefore that satisfy this need.

In accordance with a first aspect of the present invention, a method of treating a post-inserting terminal is provided which comprises the steps of fixing vicinities of ends of electric wires laid out on a wire laying-out board by wire clamps on the laying-out board whereby the ends of the electric wires project outwardly with respect to the wire laying-out board, caulking terminals including a post-inserting terminal on the projecting ends of the electric wires, detaching the end of the electric wire having the post-inserting terminal from the wire clamp, and temporarily holding the post-inserting terminal in a temporary holding member provided on the wire laying-out board.

In this construction, the post-inserting terminal detached from the wire clamp by the terminal inserting device can be temporarily held on the wire laying-out board. Consequently, the wire laying-out board is conveyed to the succeeding processes while all the terminals caulked on the laid out electric wires are detached from the wire clamps and are held in a predetermined state. In detaching a wiring assembly after passing through the respective processes from the wire laying-out board, it is easy to detach the post-inserting terminal by hand. Such a significant effect is produced that the wiring assembly after passing through the manufacturing processes can also be detached from the wire laying-out board without using particular jigs or exclusive machines. In addition, the post-inserting terminal is temporarily held inwardly with respect to the wire laying-out board, whereby the post-inserting terminal is not loose even when the terminal inserting device detaches the end of the electric wire of the post-inserting terminal from the wire clamp prior to the completion of the wiring assembly, thereby to make it possible to reliably prevent problems such as the deformation of the post-inserting terminal.

In accordance with a second aspect of the present invention, a temporary holding member of a post-inserting terminal used for a wiring assembly manufacturing apparatus is provided which comprises a main body portion for laying out electric wires and wire clamps juxtaposed on the main body portion for clamping vicinities of ends of the electric wires laid out on the main body portion whereby terminals, including a post-inserting terminal, caulked on the ends of the electric wires project outwardly with respect to the main body portion, and a terminal inserting device capable of detaching the vicinity of the end of the electric wire from the wire clamp on the wire laying-out board and inserting the terminal on the electric wire into a connector housing, the temporary holding member comprising a casing detachably disposed on the wire laying-out board and a temporary holding portion provided on the casing for temporarily holding the post-inserting terminal on the electric wire detached from the wire clamp by the terminal inserting device.

In this construction, the casing is fixed to the wire laying-out board for manufacturing the wiring assembly, and the post-inserting terminal is held by the temporary holding portion on the casing, whereby the post-inserting terminal detached from the wire clamp by the terminal inserting device can be temporarily held inwardly with respect to the wire laying-out board. Therefore, the manufacturing processes of the wiring assembly can be completed in a state where the post-inserting terminal is directed inwardly with respect to the wire laying-out board, thereby to make it possible to easily detach the post-inserting terminal by hand. Particularly, the casing is detachably disposed on the wire laying-out board, thereby to make it possible to make the wire laying-out board versatile by replacing the temporary holding member depending on the manufactured wiring assembly. As a result, even when the type of manufactured wiring assembly is changed, the rearrangement thereof becomes easy, thereby to improve the workability.

Furthermore, it is preferable that in the above described temporary holding member, the casing is juxtaposed with the connector housing into which the terminal is to be inserted, and the temporary holding portion opens toward the same side as a terminal insertion port of the connector housing. Since the temporary holding portion and the connector housing open toward the same side in the case, the terminal inserting device can insert the terminal and the post-inserting terminal into the connector housing and the temporary holding member, respectively by repeating an inserting operation in the same direction. Consequently, the present invention is more easily conducted, thereby to make it easy to process the post-inserting terminal.

Furthermore, it is preferable that the temporary holding portion is constituted by a plurality of types of openings corresponding to terminals to be held temporarily. Since the temporary holding portion is constituted by a plurality of types of openings corresponding to terminals to be held temporarily in the case, various types of post-inserting terminals corresponding to a single casing can be held temporarily by the casing. Even when a space where the casing is located is narrow, the casing can be easily disposed. Also from this point, it becomes easier to process the post-inserting terminal.

Additionally, it is preferable that in the above described temporary holding member, the casing is constituted by block members which can be piled up and adapted to open a lower part of the temporary holding portion. Since the casing is constituted by block members which can be piled up and adapted to open the lower part of the temporary holding portion in the case, upper and lower temporary holding portions which are defined by piling up the block members can share the same member as a ceiling portion of the lower stage and as a bottom portion of the upper stage. Consequently, a vertical space of the casing can be saved. Also from this point, the casing can be easily disposed. Particularly in allowing the post-inserting terminal to be inserted using the terminal inserting device, it is possible to easily obtain a high dimensional precision. Specifically, when the four sides of an opening of the temporary holding portion are closed, cutting processing cannot be performed, whereby treating cost is increased. In the above described construction, however, the lower part of the temporary holding portion is opened and therefore the temporary holding portions can be formed in the block members by cutting processing, thereby to make it possible to form a high-precision casing. Further, it is preferable that the block members define a plurality of types of temporary holding portions at every stage and can be replaced vertically with each other. Since the block members define a plurality of types of temporary holding portions at every stage and can be replaced vertically with each other in the case, a lot of types of casings can be constructed using the same block members by changing a combination of the block members. Consequently, casings used for manufacturing a lot of types of wiring assemblies can be constructed only by preparing predetermined block members, thereby to make it possible to improve the versatility of the temporary holding member.

In accordance with still another aspect of the present invention, a wire laying-out board is provided which comprises a movable member for successively moving at least to a module for laying out electric wires, to a module for stripping ends of the laid out electric wires, to a module for caulking terminals including a post-inserting terminal on the stripped ends of the electric wires, and to a module for inserting the terminals into connector housings, a main body portion carried by the movable member for laying out electric wires, wire clamps juxtaposed on the main body portion for clamping vicinities of the ends of the electric wires laid out on the main body whereby the terminals caulked on the ends of the electric wires are located outwardly beyond the main body to direct toward the modules, a slidable carrier on which the connector housings into which the terminals caulked on the electric wires are to be inserted and a temporary holding member into which the post-inserting terminal is to be inserted are juxtaposed along its length, and the length is parallel to the direction in which the wire clamps are juxtaposed and a guide member for holding the slidable carrier movably between a retreat position where the slidable carrier retreats from the wire clamps so as to process the electric wires and an insertion position where the terminals and the post-inserting terminal can be inserted into the connector housings and the temporary holding member, respectively by the terminal inserting module.

If this wire laying-out board is employed, it is possible to temporarily hold a post-inserting terminal easily utilizing well-known wiring assembly production facilities. Consequently, the present invention can be easily conducted.

BRIEF DESCRIPTION OF THE DRAWINGS

By way of example only, specific embodiments of the present invention will now be described, with reference to the accompanying drawings, in which.

DESCRIPTION OF THE PREFERRED EMBODIMENTS

Figure 2:
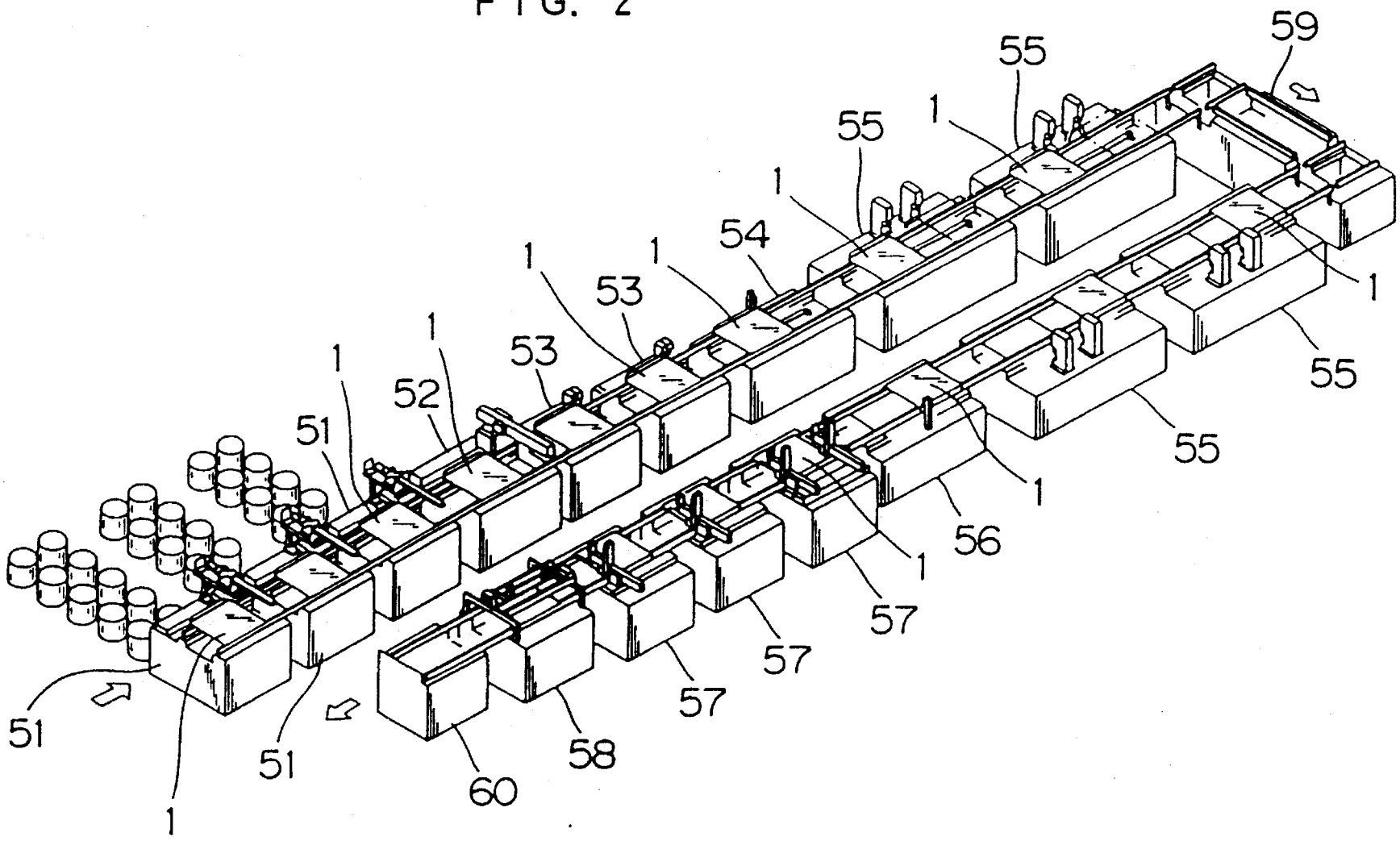
FIG. 2 is a schematic perspective view of a wiring assembly manufacturing apparatus employing one embodiment of the present invention.

Referring now to FIG. 2, a wiring assembly manufacturing apparatus according to the present embodiment is so constructed that devices modularized for each process are connected to each other with a predetermined number of devices arranged in the process.

Specifically, the wiring assembly manufacturing apparatus is so constructed that three automatic wire laying-out modules 51, one automatic taping module 52, two stripping modules 53, one stripping testing module 54, four terminal clamping modules 55, one clamping testing module 56, three terminal inserting modules 57, and one conduction testing module 58 are connected in series in this order. Since the wiring assembly manufacturing apparatus is folded back on the downstream side of the second terminal clamping module 55, a buffer module for conveyance 59 is inserted between the second terminal clamping module 55 and the third terminal clamping module 55. In addition, a buffer module 60 is connected to the conduction testing module 58 on the downstream side thereof. A wire laying-out board 1 is intermittently conveyed by a well-known wire laying-out board conveying mechanism from a module to a module.

Referring now to FIGS. 1 and 3 to 6B, the wire laying-out board 1 will be described in detail. In the following description, the upper part and the lower part of FIGS. 3, 6A and 6B shall be respectively referred to as the front and the rear of the wire laying-out board 1.

Figure 1:
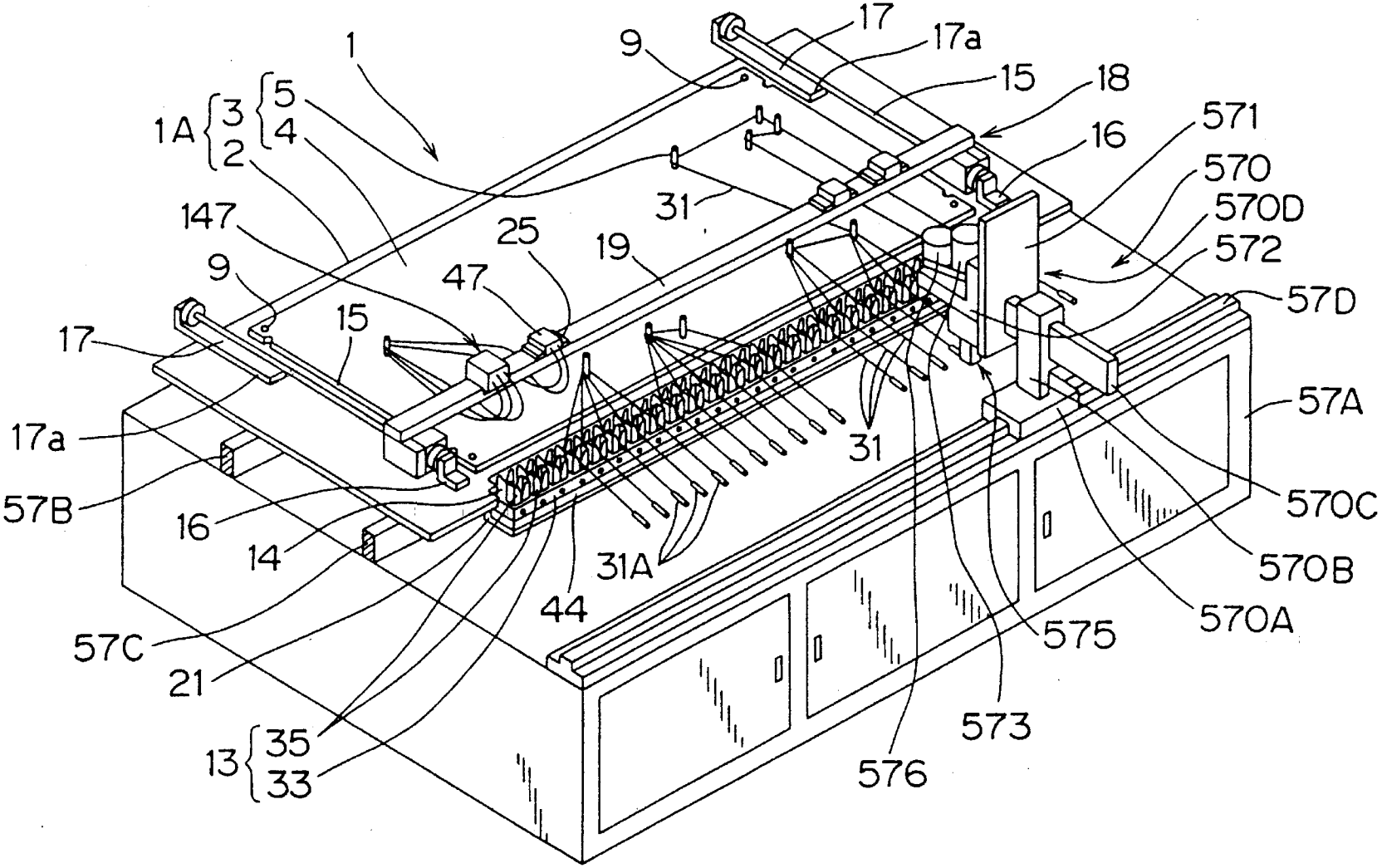
FIG. 1 is a perspective view showing the whole of a terminal inserting module according to one embodiment of the present invention.
Figure 3:
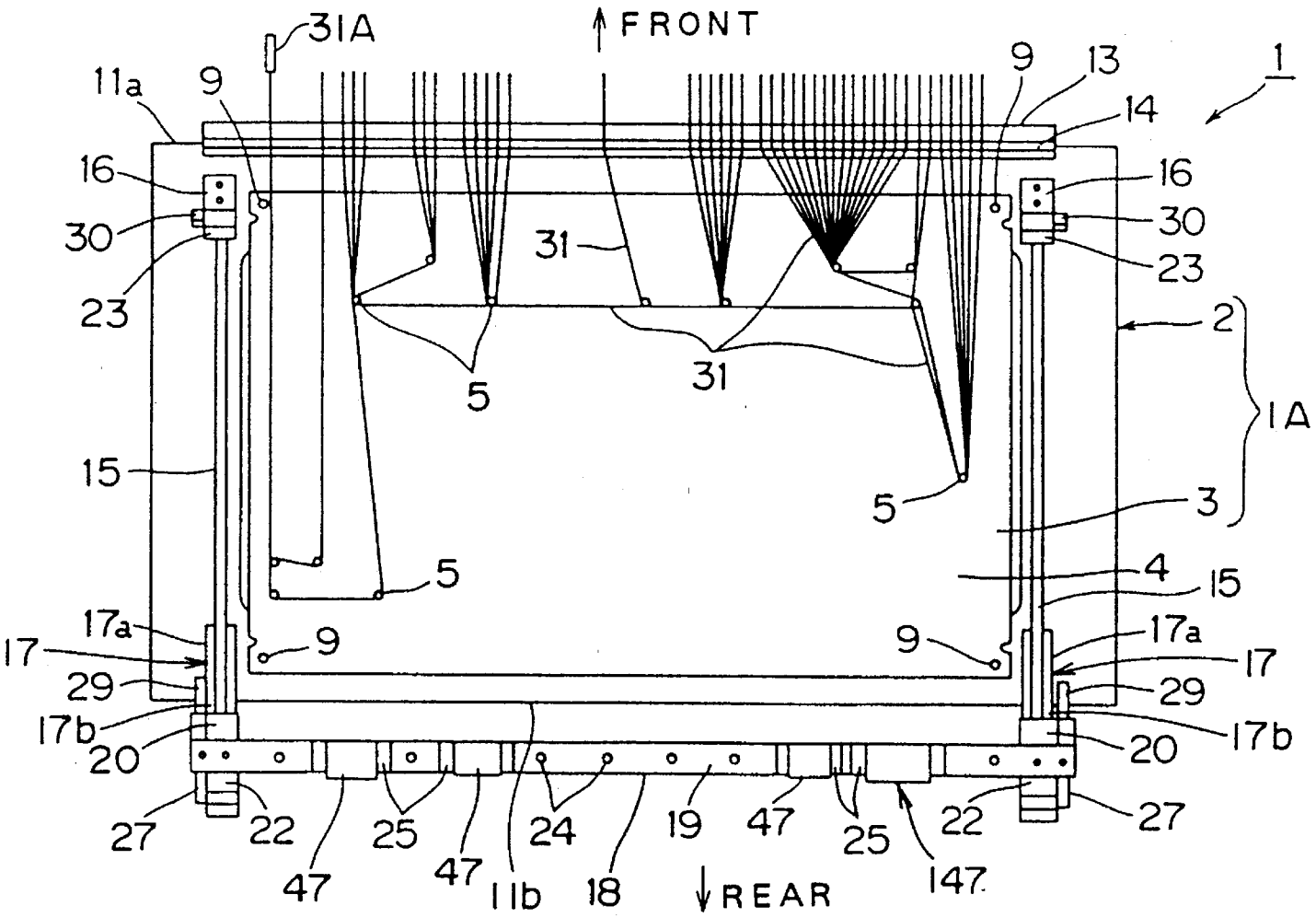
FIG. 3 is a plan view of a wire laying-out board showing a state where electric wires are lied out.
Figure 6B:
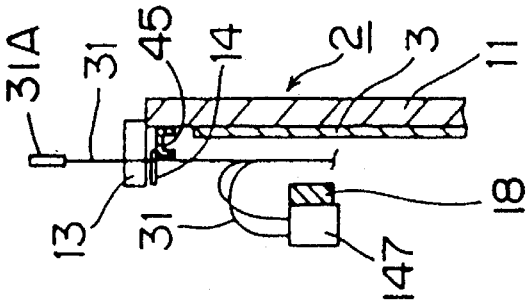
FIG. 6B is a perspective cross sectional view taken along a line 6B—6B shown in FIG. 6A.
Figure 6A:
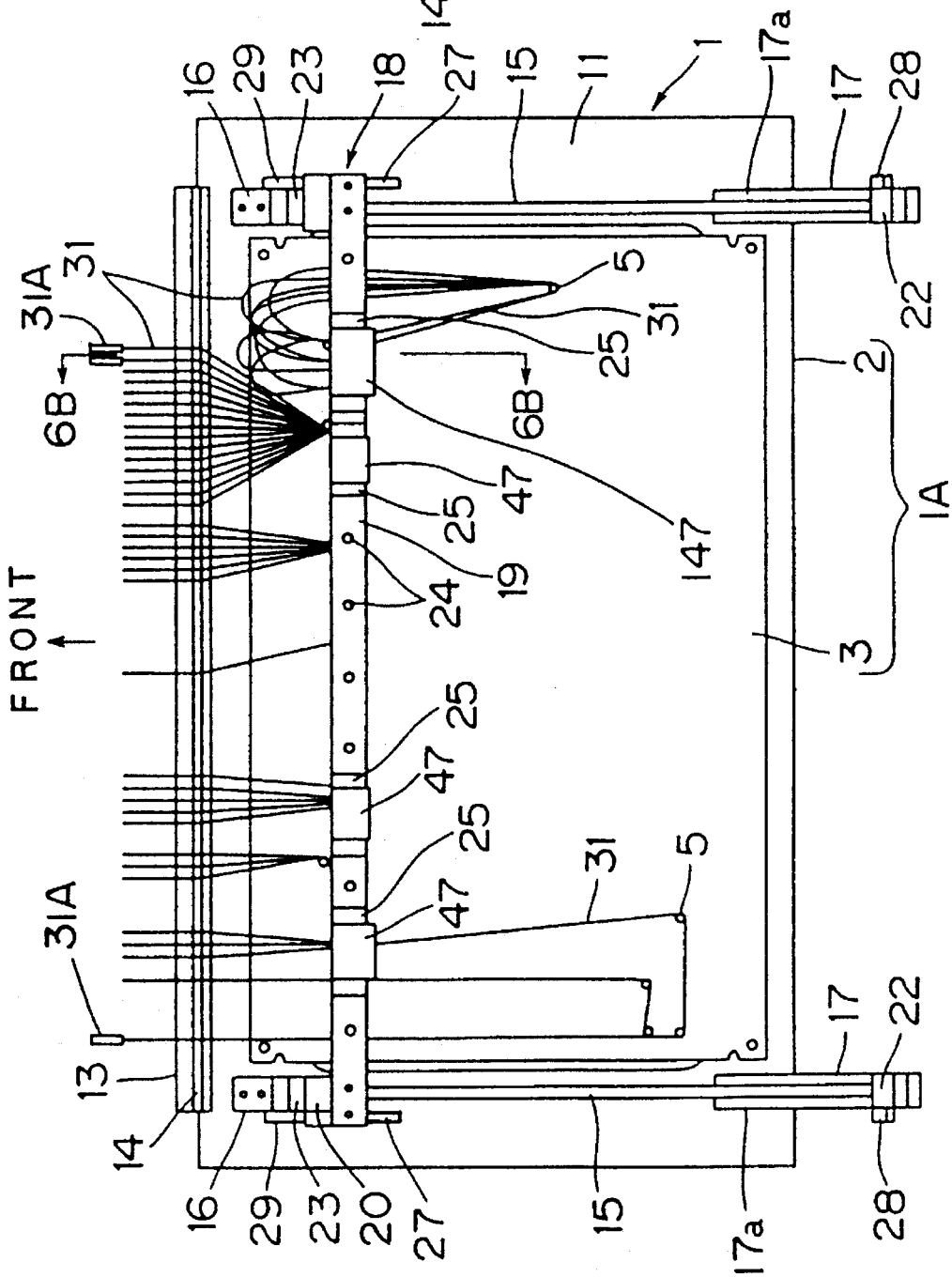
FIG. 6A is a plan view of a wire laying-out board showing the process of inserting terminals.

Referring now to FIG. 1, FIG. 3 and FIG. 6A, the wire laying-out board 1 comprises a main body portion 1A including a base plate 2 and a pin board 3 attached to the base plate 2 by screws 9. Ends of electric wires 31 are clamped by a wire clamp 13 as described later in a state where the ends of electric wires 31 project by a predetermined length beyond a leading edge 11*a* of the base plate 2, as shown in FIGS. 3, 6A, and 6B. The pin board 3 has a thin rectangular board 4 and a lot of wire laying-out pins 5 studded on the surface of the board 4. A required number of wire laying-out pins 5 are disposed at required positions according to the shape of a product to be laid out, that is, the shape of a wiring assembly. There will be prepared a pin board 3 which has studded thereon wire laying-out pins 5 corresponding to every wiring assembly to be produced. The base plate 2 is an aluminum product, for example, formed into a rectangular outer plane shape. The base plate 2 is provided with a large open window (not shown) so as to achieve lighter weight. A positioning projection is formed on the upper surface of the base plate 2, which is not specifically illustrated. The pin board 3 is positioned by the positioning projection.

Figure 4:
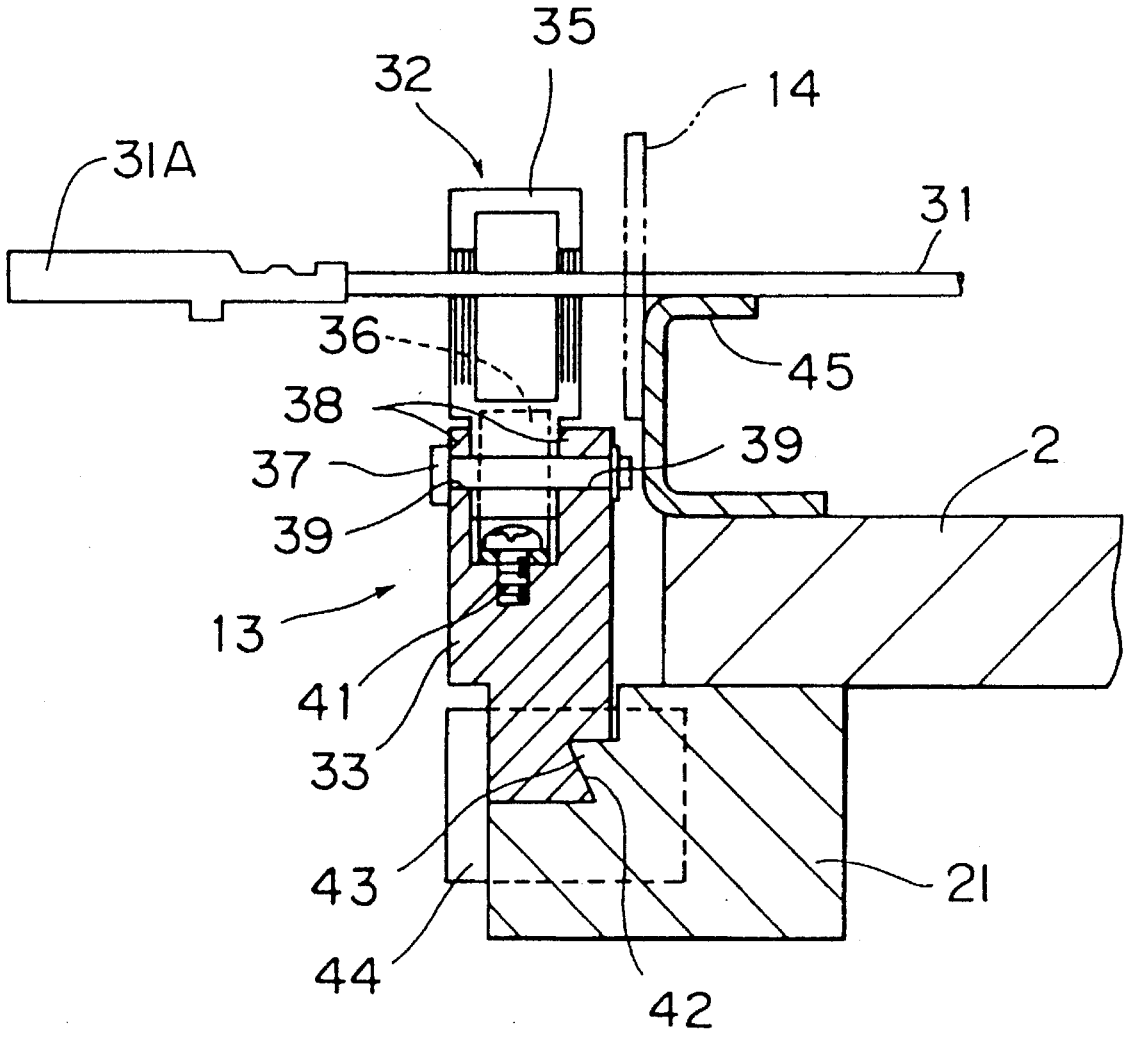
FIG. 4 is an enlarged cross sectional view of a principal part of a wire clamp in the wire laying-out board.

As shown in FIG. 4, the wire clamp 13 is provided on one side along a direction of conveyance of the base plate 2. The wire clamp 13 comprises a longitudinal frame 33 along the direction of conveyance and a lot of clamping members 35 carried by the frame 33 and juxtaposed along the one side.

The frame 33 has a rising portion 38 which is formed into a substantially U shape in cross section on its upper part. The rising portion 38 forms a recess into which the clamping members 35 are contained. The clamping members 35 are screwed into the inner bottom surface of the rising portion 38 by mounting bolts 41. In addition, a mounting hole 39 opening in a horizontal direction which is orthogonal to the direction of conveyance is formed in the rising portion 38, and a mounting pin 37 is inserted through the mounting hole 39 and the clamping member 35. The frame 33 is integrally fixed to the base plate 2 through a longitudinal holding frame 21 fixed to the lower surface of the base plate 2. More specifically, a positioning recess 42 along the length of the frame 33 is formed in the bottom of the frame 33, and a positioning rib 43 of the holding frame 21 is fitted therein and is fastened thereto. The clamping members 35 are mounted on the base plate 2 through the holding frame 21, whereby the clamping members 35 project outwardly with respect to the base plate 2. In addition, the frame 33 and the holding frame 21 are reinforced by L-shaped reinforcing fittings 44. The reinforcing fittings 44 extend along the length of the base plate 22, and are also used as a regulating member for regulating the movement along the length of the frame 33 and in a direction intersecting the length.

Figure 5:
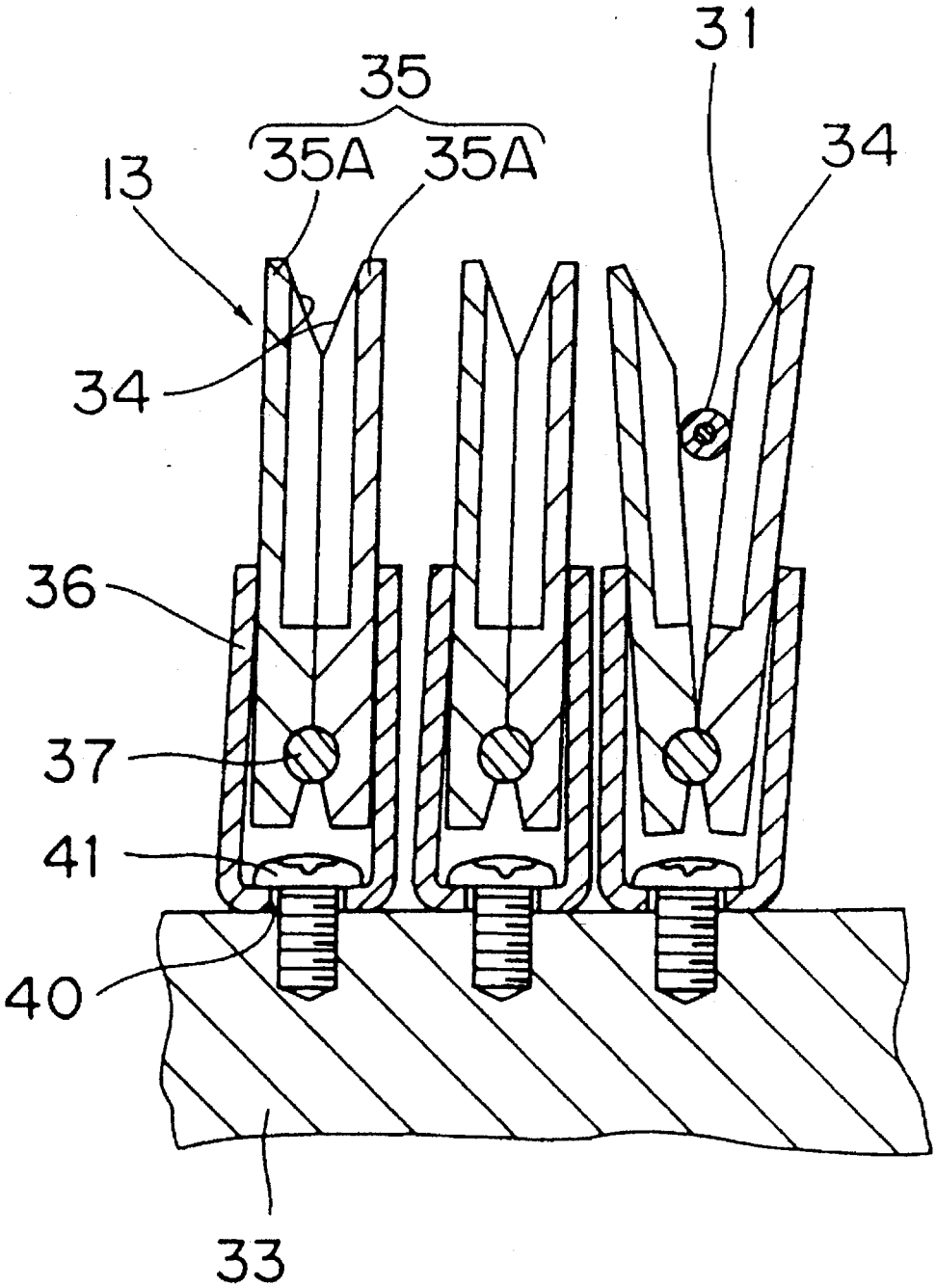
FIG. 5 is an enlarged cross sectional view of a principal part of the wire clamp showing the function thereof.

Each of the clamping members 35 is embodied by a substantially U-shaped plate spring 36 and a pair of clamping pieces 35A fitted to the plate spring 36 and having sliding surfaces 34 opposed to each other and spaced apart upward in their leading ends, as shown in FIG. 5. The clamping pieces 35A are urged in the direction in which they come closer to each other by the U-shaped plate spring 36, thereby to hold the electric wires 31 one by one. A pair of semi-cylindrical recesses are respectively opposed to each other in the base ends of the clamping pieces 35A, and a mounting pin 37 is inserted in the recesses.

A parallel comb 14 is disposed inwardly with respect to the clamping members 35. The parallel comb 14 is for disposing the vicinities of ends of the electric wires 31 held in the clamping members 35 at a predetermined pitch along the length of the wire clamp 13, that is, in a direction in which the clamping members 35 are juxtaposed and aligning the electric wires 31 in a direction orthogonal to the direction in which the clamping members 35 are juxtaposed. A lot of electric wires 31 laid out along the wire laying-out pins 5 in the pin board 3 are fitted in the parallel comb 14 and are held by the clamping members 35. Therefore, the respective ends of the electric wires 31 extend forwardly with respect to the wire laying-out board 1 from the clamping members 35 and project, parallel to each other with predetermined spacing, beyond the wire laying-out board 1. The parallel comb 14 is mounted on a height adjusting member 45 which is in a substantially channel like shape in longitudinal cross section. The heights of the electric wires 31 from the surface of the base plate 2 are made equal to each other by the height adjusting member 45, and the arrangement pitches of the electric wires 31 are made equal to each other by the parallel comb 14, when each of the electric wires is applied to the pair of clamping pieces 35A and are held thereby. Consequently, the ends of the electric wires 31 are arranged in row and held in the leading edge 11*a* of the base plate 2 in a state where they are parallel to each other at a predetermined pitch.

A carrying mechanism of connector housings 47 which is mounted on the base plate 2 in the wire laying-out board 1 will be described with reference to FIG. 3 and FIG. 6A.

First, the carrying mechanism of the connector housings 47 comprises a pair of slide guide bars 15 disposed along the both short sides of the base plate 2, first and second holding members 16 and 17 for mounting each of the slide guide bars 15 on the base plate 2, and a slidable carrier 18 laid between the both slide guide bars 15.

The front end of each of the slide guide bars 15 is held in the first holding member 16, and the rear end thereof is held in the second holding member 17. The front 17*a* of the second holding member 17 is fastened to the surface of the base plate 2, and the rear 17*b* thereof extends backwardly beyond a trailing edge 11*b* of the base plate 2. Therefore, the rear of the slide guide bar 15 also extends backwardly beyond the trailing edge 11*b* of the base plate 2.

The first and second holding members 16 and 17 raise the slide guide bar 15 and carry the slide guide bar 15 above the upper surface of the base plate 2 with a predetermined distance. Therefore, the slide guide bars 15 can slidably guide the slidable carrier 18 above the wire laying-out board 1. In addition, the slidable carrier 18 can approach the wire clamp 13 in a position above the main body portion 1A of the wire laying-out board 1 (see FIG. 1 and FIG. 6A). The amount of extension of the slide guide bar 15 defined backwardly by the second holding member 17 is set whereby the slidable carrier 18 can retreat from the pin board 3 (see FIG. 3).

The slidable carrier 18 comprises a housing mounting plate 19 extending parallel to the long side of the base plate 2 and sliding members 20 respectively mounted on both ends of the housing mounting plate 19 and slidably engaged with the slide guide bars 15. Therefore, the slidable carrier 18 is guided by the slide guide bars 15 so that it is slidable back and forth with respect to the base plate 2.

The housing mounting plate 19 has housing holding stands 25 for mounting connector housings 47 on its upper surface. The housing holding stands 25 are members which are in a U shape as viewed from the front, and respectively hold the connector housings 47 having predetermined shapes. Each of the connector housings 47 held by the housing holding stands 25 is so held that its terminal insertion port is directed forwardly with respect to the wire laying-out board 1. In the present embodiment, a lot of pins 24 are studded on the upper surface of the housing mounting plate 19 and are engaged in recesses (not shown) formed in the lower surfaces of the housing holding stands 25. The housing holding stands 25 are detachably fixed to predetermined positions of the housing mounting plate 19 by fitting the pins 24 to the recesses. The connector housings 47 are respectively fitted to the housing holding stands 25 fixed on the housing mounting plate 19, thereby to hold the connector housings 47.

Figure 7:
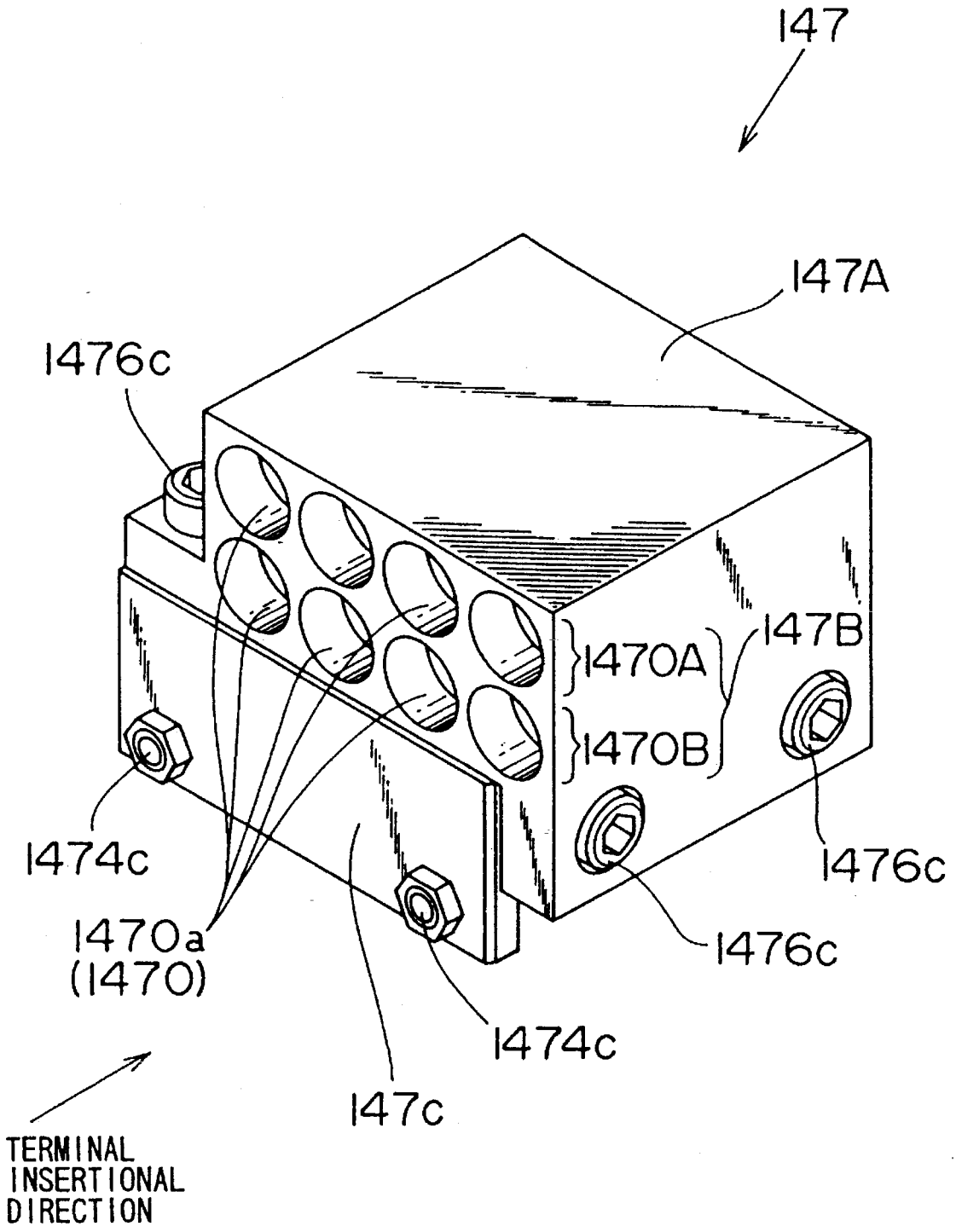
FIG. 7 is a perspective view showing the appearance of a temporary holding member according to one embodiment of the present invention.
Figure 8:
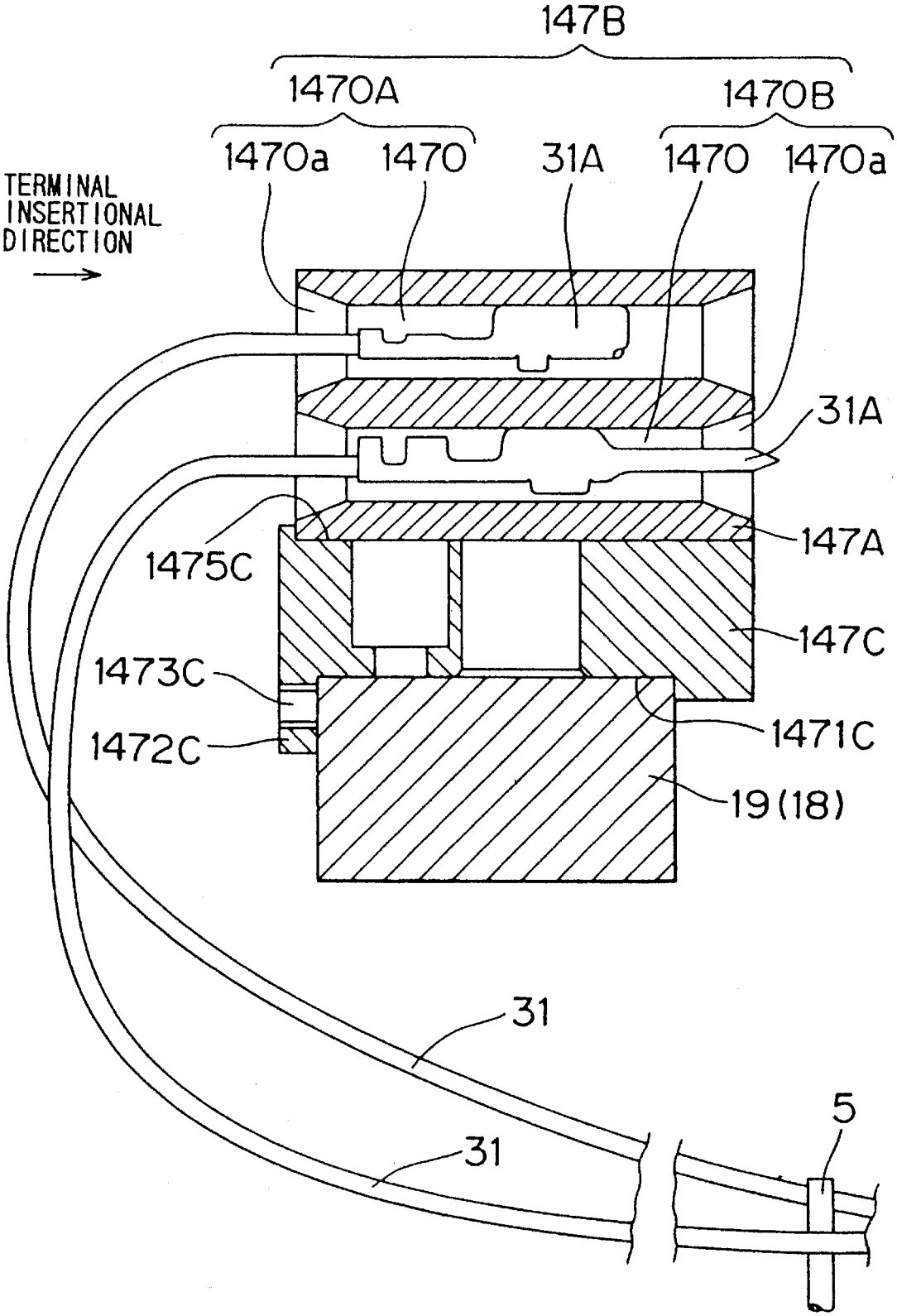
FIG. 8 is a cross sectional view of the temporary holding member shown in FIG. 7.

Referring now to FIGS. 7 and 8, a temporary holding member 147 carried by the housing mounting plate 19 will be described in detail.

AS shown in FIG. 7, the temporary holding member 147 comprises a casing 147A constituting the exterior thereof and a temporary holding portion 147B formed on the casing 147A as a principal part for temporarily holding a terminal 31A. In the present embodiment, "temporarily holding" means that the terminal 31A is held in a state where it can be easily detached by hand without using jigs.

The casing 147A is embodied by a block member which can easily be produced such as polyvinyl chloride, and is detachably fixed to the housing mounting plate 19 through the mounting member 147C.

The temporary holding portion 147B is embodied by piecing rows of openings 1470A and 1470B in two stages each comprising a lot of openings 1470 in the front of the block member constituting the casing 147A for temporarily holding a post-inserting terminal 31A. The openings 1470 in the present embodiment are so formed as to have the same diameter larger than the maximum diameter of a post-inserting terminal 31A to be inserted, and any type of terminal 31A is loosely fittable in each of the openings 1470. Further, a chamfer 1470*a* for easily inserting the post-inserting terminal 31A is formed in at least an end on the insertion side of each of the openings 1470.

Referring to FIG. 8, the mounting member 147C is constituted by a block member made of stainless, and has a mounting step 1471C mounted on the housing mounting plate 19 on its lower surface. Bolt holes 1473C are provided in a front plate portion 1472C defining the mounting step 1471C, and the mounting member 147C is detachably fixed to the housing mounting plate 19 by bolts 1474C (see FIG. 7) screwed into the bolt holes 1473C. A positioning step 1475C for positioning the casing 147A as shown is formed on the upper surface of the mounting member 147C. The casing 147A is positioned in the positioning step 1475C and is fixed thereto by hexagon socket head cap bolts 1476C (as shown only in FIG. 7).

As shown in FIG. 8, the positioning step 1475C positions the casing 147A so that the temporary holding portion 147B opens along with a terminal insertional direction. The terminal insertional direction is directed at an angle of 180° inversely to the direction in which the ends of the electric wires 31 locked in the wire laying-out pins 5 on the wire laying-out board 1 extend toward the above described wire clamp 13. Therefore, the post-inserting terminal 31A passes under the housing mounting plate 19 and turns back when the post-inserting terminal 31A is reversed and are inserted into the temporary holding portion 147B.

The terminal inserting module 57 for inserting the terminals 31A into the connector housings 47 and the temporary holding member 147 will be described in detail with reference to FIGS. 1 and 9.

The terminal inserting module 57 according to the present embodiment comprises a base 57A, a pair of rails 57B and 57C on the base 57A for conveying the wire laying-out board 1, a slide base 57D provided along the rails 57B and 57C, and a terminal inserting unit 570 disposed on the slide base 57D.

The terminal inserting unit 570 comprises a base block 570A disposed on the slide base 57D and displaceable along the slide base 57D, a standing block 570B stood on the base block 570A, a horizontal block 570C supported by the standing block 570B displaceably in a horizontal direction orthogonal to the standing block 570B and the slide base 57D, and a clamp unit 570D fixed to an end of the horizontal block 570C and opposable to the wire laying-out board 1 conveyed onto the rails 57B and 57C.

Figure 9:
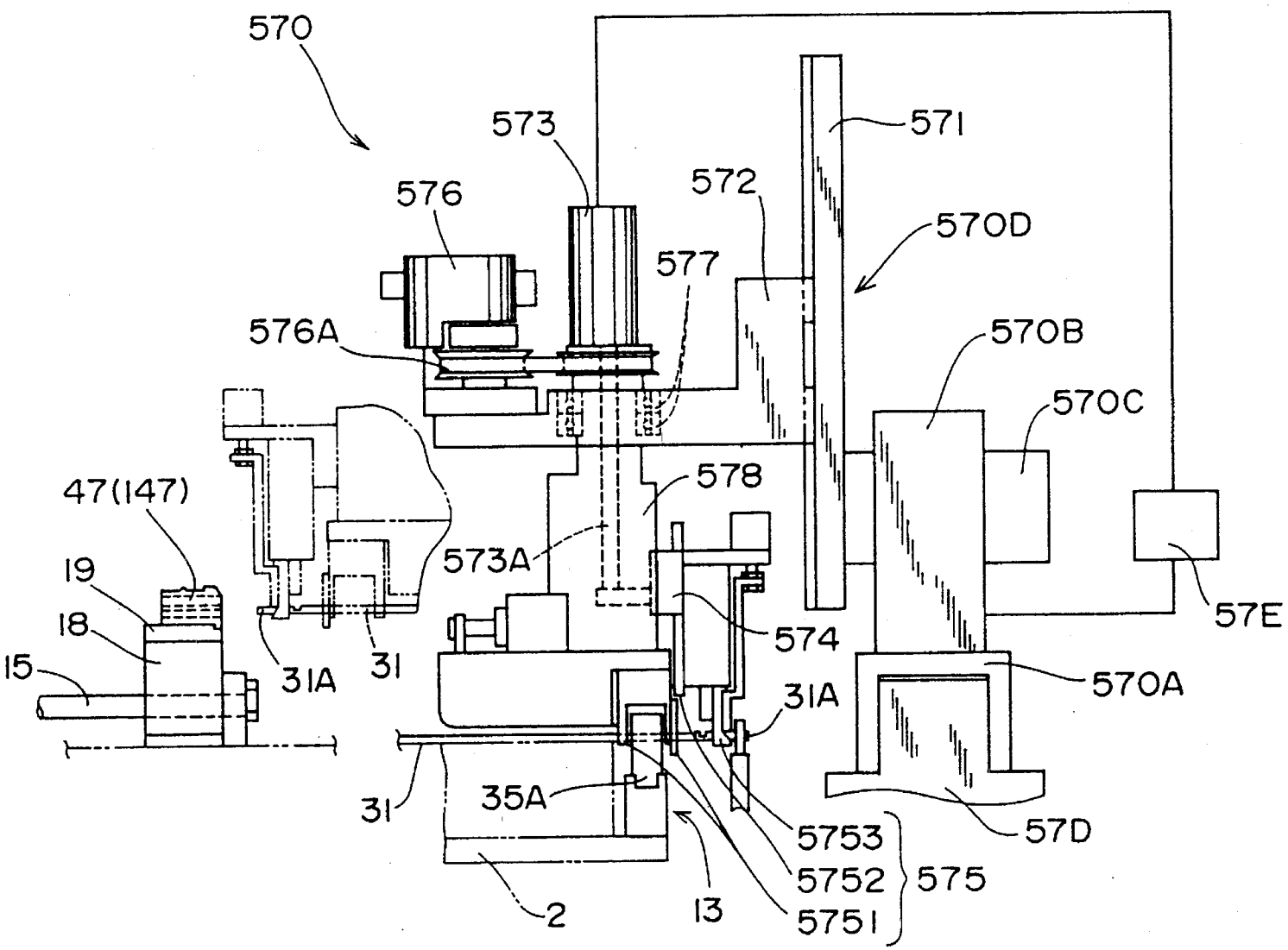
FIG. 9 is a schematic front view of a terminal inserting unit serving as a terminal inserting device according to the present invention.

Referring to FIG. 9 which is a schematic front view of the terminal inserting unit 570 or the terminal inserting device according to the present invention, the clamp unit 570D comprises an up-and-down guide 571 fixed to an end of the horizontal block 570C, a first up-and-down frame 572 which can be raised and lowered along the up-and-down guide 571, a cylinder 573 carried by the first up-and-down frame 572, a second up-and-down frame 574 which is raised and lowered by the cylinder 573, and an actuator 575 for terminal clamping carried by the second up-and-down frame 574.

A rotatable frame 578 rotatably supported through a bearing 577 is disposed concentrically with a rod 573A of the cylinder 573 in a horizontal portion of the first up-and-down frame 572. The rotatable frame 578 is for carrying the second up-and-down frame 574 so as to-be raised and lowered. On the other hand, a rotary actuator 576 is carried in the horizontal portion of the first up-and-down frame 572, and the rotatable frame 578 is rotatably connected thereto through a timing belt 576A. Consequently, the rotatable frame 578 is rotated alternately in a clockwise and counter-clockwise directions by an angle of 180° between a state as indicated by a solid line in FIG. 9 and a state indicated by a two-dot and dash line, thereby to make it possible to displace the actuator 575 for terminal clamping to such a position that it faces the wire laying-out board 1 conveyed onto the rails 57B and 57C and such a position that it turns its back to the wire laying-out board 1. The position of the first up-and-down frame 572 is controlled accurately using a linear scale, for example.

The actuator 575 for terminal clamping comprises a wire chuck 5751 for clamping the end of the electric wire 31 held by the wire clamp 13, a clamp releasing bar 5752 for releasing the clamping of the electric wire 31 by the wire clamp 13, and a terminal chuck 5753 for clamping the terminal 31A clamped to the electric wire 31.

The wire chuck 5751 has pairs of chuck claws opposed to each other, which are not specifically illustrated, for rigidly clamping a plurality of portions of the electric wire 31 by the clutch claws. Further, the wire chuck 5751 is driven open or close by a well-known air chuck.

The clamp releasing bar 5752 is lowered by a cylinder (not shown) when the wire chuck 5751 clamps the electric wire 31 to pick up the electric wire 31, and enters a portion between the clamping pieces 35A in the wire clamp 13 to open the clamping pieces 35A so that the electric wire 31 can be easily picked up.

The terminal chuck 5753 has pairs of chuck claws opposed to each other, which are not specifically illustrated, for rigidly clamping the terminal 31A fixed to the end of the electric wire 31 by the chuck claws.

The terminal inserting unit 570 is controlled by a control section 57E. The control section 57E is constituted by a microprocessor and other electrical equipments for controlling the driving of the respective modules each including the terminal inserting unit 570. The control section 57E stores work information on the terminal inserting unit 570, for example, which terminal 31A is to be inserted into the connector housing 47 or the temporary holding member 147 whereby the terminal inserting unit 570 is driven as described later to insert the predetermined terminals 31A into the connector housings 47 and insert the post-inserting terminal 31A into the temporary holding member 147. The structures of the control section 57E and therefore the terminal inserting unit 570 thus differ from the conventional structures in that the process of inserting the post-inserting terminal 31A which will be connected in the post-inserting process into the temporary holding member 147 is included.

Description is now made of the function of the present embodiment.

Referring now to FIGS. 1 and 2, when a wiring assembly such as a wiring harness is manufactured in the above described wiring assembly manufacturing apparatus, the wire laying-out board 1 is successively conveyed from the automatic wire laying-out modules 51 until the conduction testing module 58 through a module to a module, and a lot of electric wires 31 are laid out and assembled on the wire laying-out board 1. Prior to the conveyance of the wire laying-out board 1, the predetermined connector housings 47 and the temporary holding member 147 are mounted on the housing mounting plate 19 on the wire-laying out board 1 (see FIGS. 1 and 3).

Referring to FIG. 2, the foregoing will be described in more detail. In the automatic wire laying-out module 51, the electric wires 31 are laid out on the wire laying-out board 1, as shown in FIG. 3. In this case, the slidable carrier 18 is positioned at the rear ends of the slide guide bars 15, as shown in FIG. 3. Specifically, the slidable carrier 18 retreats to the rear of the pin board 3 so that it is not positioned above the pin board 3. Therefore, there are no obstacles above the pin board 3, whereby the electric wires 31 can be successively laid out by a machine. In this case, the slidable carrier 18 slid to the rearmost position abuts against cushioning members 22. A locking hook 27 projecting from the sliding member 20 is engaged with a locking piece 28 provided for the second holding member 17, whereby the slidable carrier 18 is fixed in the rearmost position. The vicinities of the ends of the laid out electric wires 31 project beyond the wire laying-out board 1.

As shown in FIG. 6A, when the wire laying-out process is terminated, the slidable carrier 18 slides forwardly to the foremost position along the slide guide bars 15 and is fixed thereto. In this case, the slidable carrier 18 slides to the foremost position and contacts against cushioning members 23 provided in the leading ends of the slide guide bars 15. A locking hook 29 projecting from the sliding member 20 is engaged with a locking piece 30 provided for the first holding member 16. Consequently, the slidable carrier 18 is fixed at the foremost position. The displacement of the slidable carrier 18 from the position shown in FIG. 3 to the position shown in FIG. 6A may be at any timing prior to the terminal inserting process after the wire laying-out process and the taping process are terminated.

Turning back to FIG. 2, if the electric wires have been laid out, the projecting ends of the electric wires 31 will be stripped by the stripping modules 53, whereby conductors of the electric wires 31 will be exposed. In addition, the terminal 31A is caulked by the terminal clamping modules 55 to the end of the electric wire 31 which passed the test by the stripping testing module 54, and is integrally fixed thereto.

The wire laying-out board 1 after passing through the terminal clamping process is conveyed to the terminal inserting modules 57, as shown in FIG. 1, where the terminal inserting process is carried out by the terminal inserting unit 570 shown in FIG. 9.

If the wire laying-out board 1 is conveyed to a predetermined position of the terminal inserting module 57, the wire laying-out board 1 halts at the position shown in FIG. 1. The standing block 570B is moved along the slide base 57D, and is opposed to the electric wire 31 held by the predetermined clamping member 35 and also the terminal 31A clamped to the end of the electric wire 31. The first up-and-down frame 572 is then lowered along the up-and-down guide 571, whereby a pick-up operation is started by the actuator 575 for terminal clamping.

Referring to FIG. 9, if the first up-and-down frame 572 is lowered, the wire chuck 5751 and the terminal chuck 5753 whose claws are opened are lowered to the position where they can clamp the electric wire 31. The air chuck is then driven, whereby the claws of each of the chucks 5751 and 5753 are closed, so that the electric wire 31 and the terminal 31A are clamped therein.

After the clamp releasing bar 5752 is lowered to open the wire clamp 13 whereby a leading end portion of the electric wire 31 can be picked up, the first up-and-down frame 572 is raised, whereby the actuator 575 for terminal clamping picks up the terminal 31A together with the electric wire 31. If the pick-up operation is completed, the leading end portion of the electric wire 31 is released and free from the wire clamp 13. In addition, the rotary actuator 576 is driven, and the rotatable frame 578 is rotated by 180° (see a two-dot and dash line in FIG. 9). Consequently, the terminal 31A is returned inwardly to the wire laying-out board 1. The standing block 570B is moved along the slide base 57D as required, whereby a leading end of the terminal 31A is opposed to the predetermined connector housing 47 or the temporary holding member 147. In the above described pick-up operation, the lifting amount of the actuator for terminal clamping 575 is previously set to a predetermined value, thereby to make it possible to accurately oppose the terminal 31A to the terminal insertion port of the connector housing 47 and the temporary holding portion 147B in the temporary holding member 147 (see FIGS. 7 and 8) on the housing mounting plate 19 above the wire laying-out board 1.

The terminal clamping actuator 575 will then insert the terminals 31A sequentially and alternately into the connector housing 47 or the temporary holding member 147 by moving the horizontal block 570*c* and therefore the up-and-down guide 571, the first up-and-down frame 572, the rotatable frame 578 to displace the actuator 575 toward the connector housing 47 and the temporary holding member 147. When the leading end B2 of the terminal 31A is inserted into the connector housing 47 or the temporary holding member 147 by a predetermined amount, the terminal chuck 5753 releases the clamping of the terminal 31A and the cylinder 573 is then driven by the control section 57E to cause to retreat the terminal chuck 5753 upwardly, and the wire chuck 5751 is brought near the connector housing 47 or the temporary holding member 147 by the horizontal block 570C to insert the terminal 31A into a predetermined position of the connector housing 47 or the temporary holding member 147.

As best shown in FIG. 1, the direction in which the terminals 31A are inserted into the connector housings 47 and the temporary holding member 147 is directed backwardly with respect to the wire laying-out board 1. Consequently, the ends of the laid out electric wires 31 on the wire laying-out board 1 in a strained state are detached from the clamping members 35 and are inserted backwardly or bent reversely. Therefore, the reaction force is developed in the reversed electric wire 31 in a direction in which the post-inserting terminal 31A is stood. As shown in FIG. 8, the reaction force causes the post-inserting terminal 31A to press against the upper inner surface of the opening 1470, whereby the post-inserting terminal 31A is locked in the openings 1470 by the frictional force developed therebetween. Consequently, even when the post-inserting terminal 31A is loosely fitted in the opening 1470 as described above, the post-inserting terminal 31A is temporarily held in each of the openings 1470 or the temporary holding portion 147B in a state where it can be detached by hand. Moreover, the ends of the electric wires 31 are returned backwardly and are inserted, thereby to make it possible to insert the terminals 31A easily into the connector housings 47 and the temporary holding member 147 without the application of the further strain.

The ends of the electric wires 31 can also be detached from the clamping members 35 and inserted into the arbitrary connector housings 47 not in the order of arrangement but in an arbitrary order.

The above described operations are repeated for each electric wire 31 held by the clamping members 35, thereby to make it possible to insert the terminal 31A into the connector housing 47 or the temporary holding member 147.

When the wire laying-out board 1 finishes the terminal inserting process, all the terminals 31A caulked on the laid out electric wires 31 are inserted into any of the connector housings 47 and the temporary holding member 147. Consequently, the wire laying-out board 1 is conveyed to the conduction testing module 58 in a state where all the electric wires 31 are detached from the wire clamp 13.

The wire laying-out board 1 which finishes the conduction test is conveyed to the buffer module 60, where the electric wires 31 laid out are detached from the pin board 3 in the wire laying-out board 1. In this detaching processing, the terminal 31A to be the post-inserting terminal can be simply pulled out from the temporary holding portion 147B in the temporary holding member 147 by manual operation without using jigs.

As described in the foregoing, in the construction according to the present embodiment, the end of the electric wire of the post-inserting terminal 31A can be detached from the wire clamp 13 utilizing the terminal inserting unit 570, and the post-inserting terminal 31A temporarily held can be detached by hand, thereby to produce such a significant effect that the wiring assembly (the electric wires 31) which finishes the manufacturing processes can be detached from the wire-laying out board 1 without using particular jigs or exclusive machines. Further, the post-inserting terminal 31A is temporarily held inwardly with respect to the wire laying-out board 1. Consequently, even when the terminal inserting unit 570 detaches the end of the electric wire of the post-inserting terminal 31A from the wire clamp 13 prior to the completion of the wiring assembly, the post-inserting terminal 31A can reliably be prevented from the problems such as the collision with the wiring assembly manufacturing apparatus.

Furthermore, in the construction according to the present embodiment, a reaction force in the reversed electric wire 31 causes the post-inserting terminal 31A loosely fitted in the opening 1470 to be pressed against the inner upper surface of the opening 1470, whereby the post-inserting terminal 31A is locked therein by the frictional force therebetween. Consequently, even when an opening 1470 having a relatively low dimensional precision is used, it is possible to temporarily hold the post-inserting terminal 31A by the terminal inserting unit 570. This contributes to the easy manufacturing of the wiring assembly and therefore to the reduction in cost. Accordingly, it is possible to easily process the post-inserting terminal 31A.

Additionally, the temporary holding member 147 is replaced depending on the wiring assembly to be manufactured, thereby to make the wire laying-out board 1 versatile. Therefore, even in changing the type of wiring assembly to be manufactured, the rearrangement thereof becomes easy, thereby to improve the workability.

Furthermore, the temporary holding portion 147B opens to the same side as the connector housings 47. Accordingly, the terminal inserting unit 570 can carry out the process of inserting the terminals to the connector housings 47 and the process of temporarily holding the post-inserting terminal 31A by the temporary holding member 147 by repeating an inserting operation in the same direction. As a result, the present invention is more easily conducted, thereby to make it easy to process the post-inserting terminal 31A.

Additionally, various types of post-inserting terminals 31A corresponding to a single casing 147A can be temporarily held in the casing 147A. Even when a space where the casing 147A is located is narrow as in the above described housing mounting plate 19, the casing 147A can be easily disposed. Also from this point, it becomes easier to process the post-inserting terminal 31A.

Figure 10:
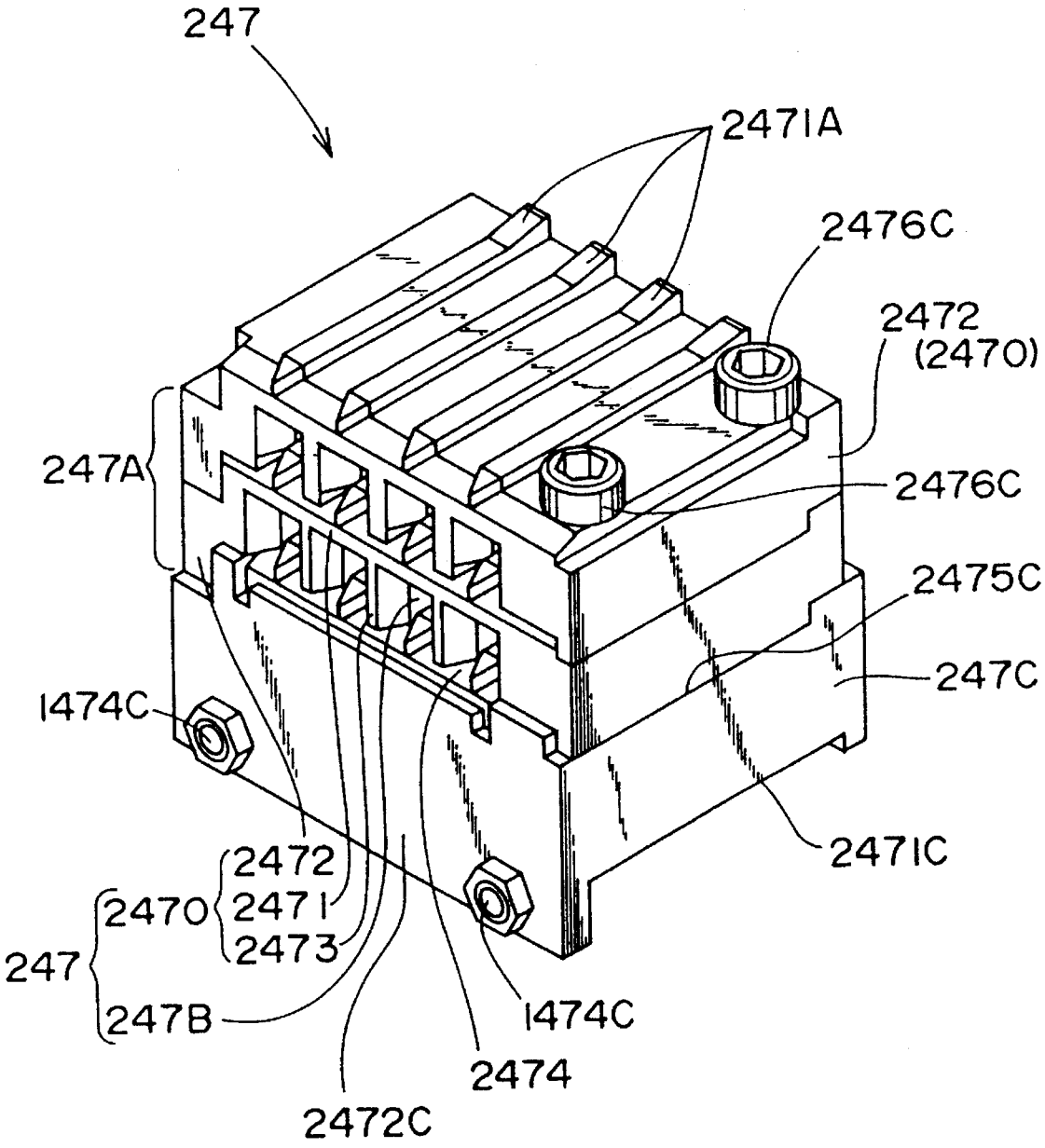
FIG. 10 is a perspective view showing the appearance of a temporary holding member according to another embodiment of the present invention.
Figure 11:
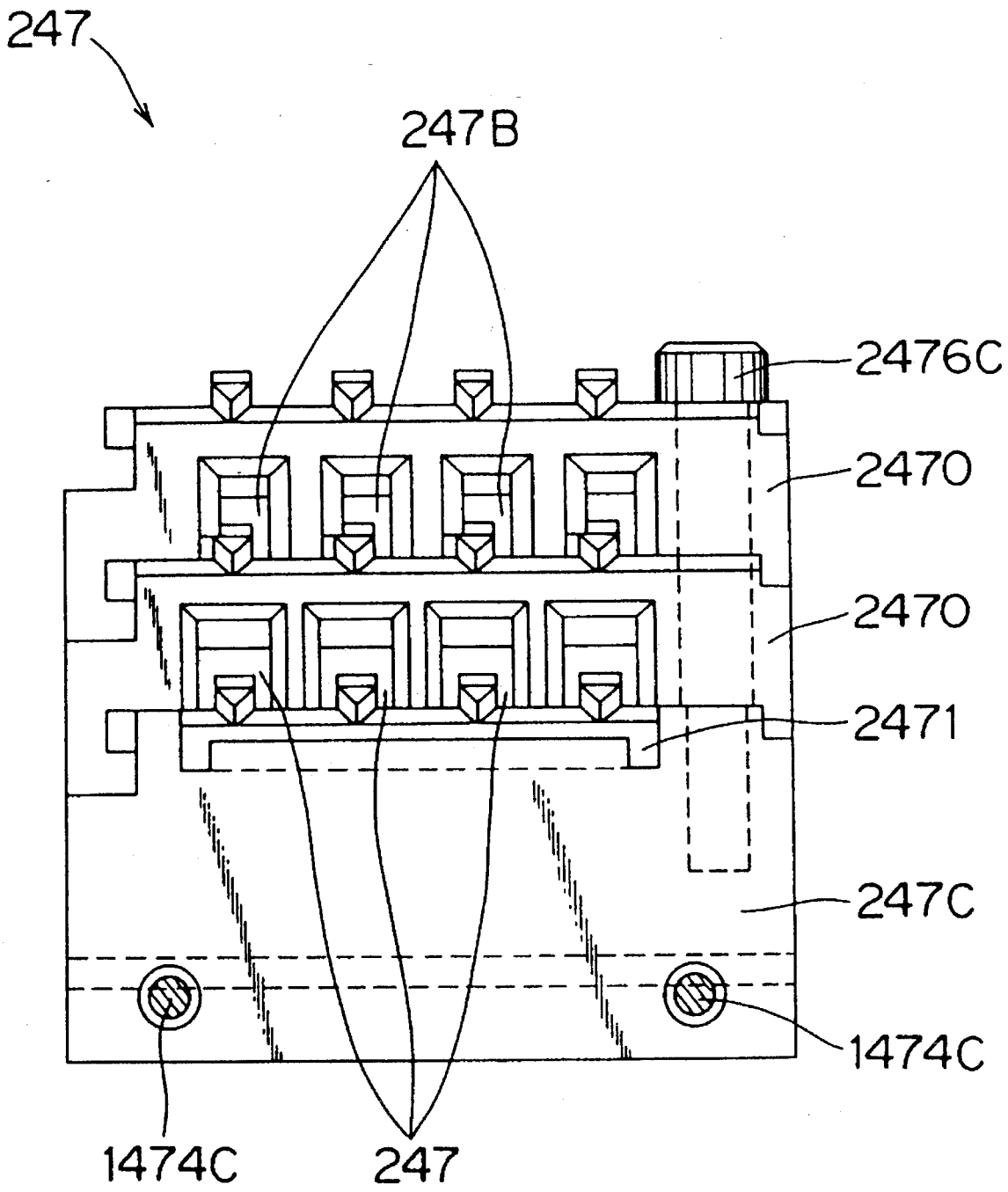
FIG. 11 is a cross sectional view of the temporary holding member shown in FIG. 10.

As the temporary holding member, the construction shown in FIGS. 10 and 11 can be employed. Referring to FIGS. 10 and 11, a casing 247A which is constituted by a lot of block members 2470 is employed in a temporary holding member 247 shown in FIGS. 10 and 11.

Each of the block members 2470 is a resin molded product integrally comprising a ceiling board portion 2471, a pair of connecting sidewalls 2472 hanging from both sides of the ceiling board portion 2471, and a lot of partitioning plates 2473 hanging from the lower surface of the ceiling board portion 2471 for defining temporary holding portion 247B.

The ceiling board portion 2471 comprises ribs 2471A vertically opposed to each other among the partitioning plates 2473. In addition, the lower surface of the connecting sidewall 2472 is formed in a predetermined stepped shape. Consequently, the connecting sidewall 2472 can be piled up on a positioning step 2475B formed on the upper surface of the top plate portion 2471 shown in FIG. 10. In addition, the block members 2470 define a plurality of types of temporary holding portions (openings) 247B at every stage, and can be vertically replaced with each other.

A mounting member 247C in the temporary holding member 247 is constituted by a block member made of stainless, as in the embodiment shown in FIGS. 7 and 8, and has a mounting step 2471C mounted on the above described housing mounting plate 19 on its lower surface. A front plate portion 2472C defining the mounting step 2471C is detachably fixed to the housing mounting plate 19 by bolts 1474C (see FIG. 10). A positioning step 2475C in the same shape as that of the positioning step 2475B formed on the upper surface of the ceiling board portion 2471 is formed on the upper surface of the mounting member 247C, and block members 2470 can be replaced with each other and piled up on the positioning step 2475C. The casing 247A constituted by the block members 2470 is positioned in the positioning step 2475C, and is fastened in the direction of the lamination by hexagon socket head cap bolts 2476C. A bottom plate piece 2474 constituting the bottom of the block member 2470 opposed to the mounting member 247C is laminated on the upper surface of the mounting member 247C. The bottom plate piece 2474 defines the temporary holding portions 247B in communication with the block members 2470 directly piled up on the mounting member 247C.

If the construction shown in FIGS. 10 and 11 is employed, the block members 2470 are vertically piled up, thereby to make it possible to define the temporary holding portions 247B in upper and lower stages so constructed that a ceiling board portion 2471 in the lower stage serving as a bottom plate portion in the upper stage. Moreover, a lot of types of casings can be constructed using the same block members 2470 by changing a combination of the block members 2470.

If the construction shown in FIGS. 10 and 11 is employed, therefore, the block members 2470 are vertically piled up, thereby to define the temporary holding portions 247B in upper and lower stages so constructed that a ceiling plate portion 2471 in the lower stage serves as a bottom plate portion in the upper stage. Accordingly, a vertical space of the casing 247A can be saved. Also from this point, the casing 247A can be easily disposed on the housing mounting plate 19. In the construction shown in FIGS. 10 and 11, a high dimensional precision can be easily obtained in allowing the post-inserting terminal to be inserted using the terminal inserting unit 570. Specifically, if the four sides of an opening of the temporary holding portion 247B are closed, cutting processing cannot be performed, whereby processing cost is increased. In the construction shown in FIGS. 10 and 11, however, the lower part of the temporary holding portion 247B is opened. Therefore, the temporary holding portions 247B can be formed in the block members 2470 by cutting processing, thereby to make it possible to form a high-precision casing 247A.

Furthermore, in the construction shown in FIGS. 10 and 11, a lot of types of casings 247A can be constructed using the same block members 2470 by changing a combination of the block members 2470. Only by preparing the predetermined block members 2470, therefore, the casings 247A used for manufacturing a lot of types of wiring assemblies can be constructed, thereby to make it possible to improve the versatility of the temporary holding member 247.

Figure 12:
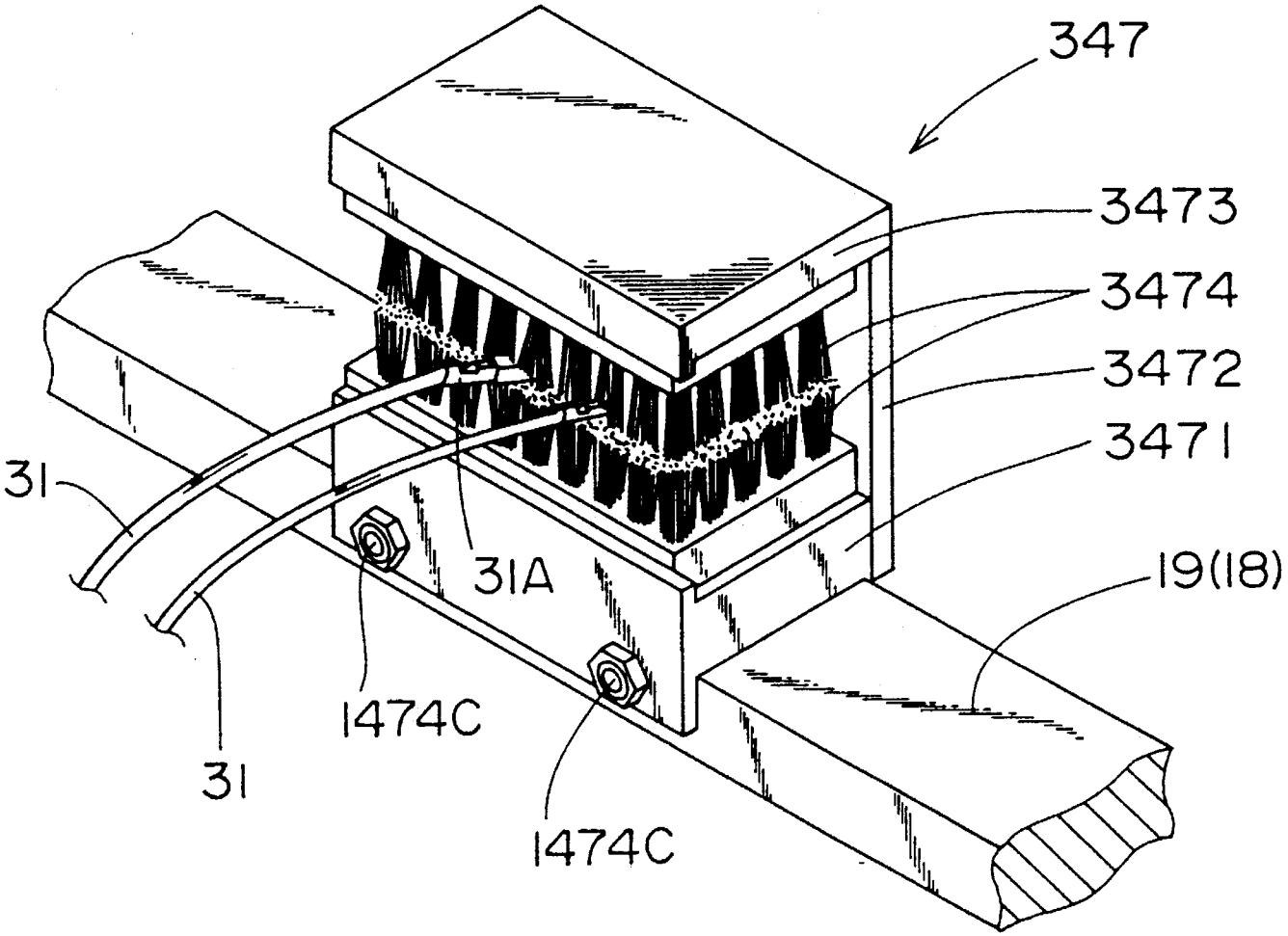
FIG. 12 is a perspective view showing the appearance of a temporary holding member according to still another embodiment of the present invention.

Additionally, as the temporary holding member, the construction shown in FIG. 12 can be employed. A temporary holding member 347 shown in FIG. 12 comprises integrally a base portion 3471 detachably fixed to a housing mounting plate 19 and used both as a casing and a mounting member, a standing portion 3472 stood from one end of the base portion 3471, and a top plate portion 3473 integrally extending from the upper end of the standing portion 3472 and vertically opposed to the base portion 3471. A lot of brush members 3474 are studded on the upper surface of the base portion 3471 and the lower surface of the top plate portion 3473, and are opposed to each other in such a position that they vertically abut against each other. The brush members 3474 constitute a temporary holding portion in the embodiment shown in FIG. 12.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A temporary holding member of a post-inserting terminal used for a wiring assembly manufacturing apparatus which includes a laying-out board having a main body portion for laying out electric wires and wire clamps juxtaposed on the main body portion for clamping in vicinities of ends of electric wires laid out on the main body portion whereby terminals, including a post-inserting terminal, caulked on the ends of the laid out electric wires project outwardly with respect to the main body portion, and a terminal inserting device capable of detaching a laid out electric wire from one of the wire clamps on the wire laying-out board and inserting the terminal thereof into a connector housing, the temporary holding member comprising:

a casing;

means for detachably mounting the casing on a wire laying-out board so that that temporary holding member moves with the wire laying-out board through a wire assembly manufacturing apparatus; and a temporary holding portion provided on the casing for temporarily holding a post-inserting terminal of an electric wire detached from the said one wire clamp by the said terminal inserting device.

2. The temporary holding member according to claim 1, wherein the casing is juxtaposed with the connector housing into which the terminal is to be inserted, and the temporary holding portion opens toward a same side as a terminal insertion port of the connector housing.

3. The temporary holding member according to claim 1, wherein the temporary holding portion is constituted by a plurality of types of openings corresponding to the terminals to be held temporarily.

4. The temporary holding member according to claim 3, wherein the casing is constituted by block members adapted to stack such that a lower part of the temporary holding portion is open.

5. The temporary holding member according to claim 4, wherein the block members define a plurality of types of temporary holding portions and can replace each other.

6. The temporary holding member according to claim 4, wherein each block member has ribs at an upper surface thereof for engaging with a lower portion of another block member.

7. The temporary holding member according to claim 1, wherein the wire laying-out board includes a slidable carrier that carries connector housings, the carrier having a mounting plate to which connector housings are detachably mounted, and wherein the means for detachably mounting the casing includes a mounting member for mounting the casing to the carrier mounting plate, in juxtaposition to connector housings carried on the carrier.

8. The temporary holding member according to claim 7, wherein the mounting member has a first step portion for receiving the carrier mounting plate.

9. The temporary holding member according to claim 8, wherein the casing includes a top plate portion in opposition with a bottom plate portion and wherein the temporary holding portion includes brush members extending from each of the opposing plate portions.

10. The temporary holding member according to claim 8, wherein the mounting member has a second step portion for positioning the casing thereon so that the temporary holding portion opens along a terminal insertion direction.

11. The temporary holding member according to claim 10, including removable fixing means for fixing the mounting member to the carrier mounting plate, and for fixing the casing to the mounting member.

* * * * *